US010254067B2

(12) United States Patent
Foster

(10) Patent No.: US 10,254,067 B2
(45) Date of Patent: Apr. 9, 2019

(54) TRIGGER-LOCKING APPARATUS, SYSTEM, AND METHOD FOR SEMIAUTOMATIC FIREARMS

(71) Applicant: FOSTECH MFG LLC, Seymour, IN (US)

(72) Inventor: David Foster, Seymour, IN (US)

(73) Assignee: FOSTECH, INC., Seymour, IN (US)

( * ) Notice: Subject to any disclaimer, the term of this patent is extended or adjusted under 35 U.S.C. 154(b) by 0 days.

(21) Appl. No.: 15/419,460

(22) Filed: Jan. 30, 2017

(65) Prior Publication Data

US 2017/0219307 A1 Aug. 3, 2017

Related U.S. Application Data

(60) Provisional application No. 62/311,807, filed on Mar. 22, 2016, provisional application No. 62/288,385, filed on Jan. 28, 2016.

(51) Int. Cl.
*F41A 17/46* (2006.01)
*F41A 19/06* (2006.01)
*F41A 17/76* (2006.01)

(52) U.S. Cl.
CPC ..... *F41A 19/06* (2013.01); *F41A 17/76* (2013.01)

(58) Field of Classification Search
CPC ..... F41A 17/48; F41A 17/68; F41A 17/46; F41A 17/32; F41A 17/42; F41A 17/74; F41A 17/76; F41A 19/02; F41A 19/24; F41A 19/26; F41A 19/25; F41A 19/27; F41A 19/30; F41A 19/45
See application file for complete search history.

(56) References Cited

U.S. PATENT DOCUMENTS 2,039,814 A * 5/1936 Loomis ..... F41A 17/48 42/20
2,869,269 A * 1/1959 Couture ..... F41A 17/32 42/70.01
3,196,747 A * 7/1965 Gallagher ..... F41A 19/31 42/69.02
3,292,492 A * 12/1966 Sturtevant ..... F41A 19/02 89/128
3,553,877 A * 1/1971 Welch et al. ..... F41A 17/02 42/70.01
3,845,688 A * 11/1974 Seecamp ..... F41A 19/45 89/146

(Continued)

*Primary Examiner* — Derrick R Morgan
(74) *Attorney, Agent, or Firm* — Roberts IP Law; John Roberts

(57) ABSTRACT

Provided in various example embodiments is an apparatus, system, and method for improved control of selectable dual mode trigger systems for semiautomatic firearms, which may include a timed locking mechanism incorporated in the trigger system that ensures that the carrier is seated before the hammer is actuated, and that the anti-hammer-follow disconnect does not engage out of sequence. Such a mechanism ensures that the necessary steps occur in the proper sequence in the trigger mechanism, so that at any given time the trigger and firearm are ready for the next desired function to occur. The addition of a timed trigger lock mechanism to the trigger as disclosed herein ensures that the sequence of events in the trigger is maintained in the proper relationship, preventing misfires and jams. Such trigger locking mechanisms have applicability beyond dual-mode trigger systems, and may be applied in various forms to semiautomatic firearms generally.

18 Claims, 4 Drawing Sheets

(56) References Cited

U.S. PATENT DOCUMENTS 3,924,599 A * 12/1975 Hammond ..... F41A 17/48 124/40
4,004,496 A * 1/1977 Snodgrass ..... F41A 19/02 89/129.02
4,023,465 A * 5/1977 Inskip ..... F41A 19/03 89/131
4,308,786 A * 1/1982 Hayashi ..... F41A 19/44 89/144
4,499,684 A * 2/1985 Repa ..... F41A 19/17 42/69.01
4,555,861 A * 12/1985 Khoury ..... F41A 17/72 42/69.01
4,697,495 A * 10/1987 Beretta ..... F41A 11/00 89/142
5,216,190 A * 6/1993 Tanaka ..... F41A 17/48 42/69.02
5,718,074 A * 2/1998 Keeney ..... F41A 19/45 42/69.01
7,398,723 B1 * 7/2008 Blakley ..... F41A 19/12 42/69.01
7,562,614 B2 * 7/2009 Polston ..... F41A 19/33 42/69.03
8,667,881 B1 * 3/2014 Hawbaker ..... F41A 19/46 42/69.01
8,820,211 B1 9/2014 Hawbaker
9,970,724 B1 * 5/2018 Acker ..... F41A 17/46
2009/0044438 A1 * 2/2009 Yollu ..... F41A 17/30 42/70.06
2011/0167697 A1 * 7/2011 Geissele ..... F41A 19/16 42/69.03
2012/0144712 A1 * 6/2012 Rostocil ..... F41A 9/79 42/16
2014/0259845 A1 * 9/2014 Johnson ..... F41A 19/09 42/69.01
2018/0087860 A1 * 3/2018 Sullivan ..... F41A 17/46

* cited by examiner

TRIGGER-LOCKING APPARATUS, SYSTEM, AND METHOD FOR SEMIAUTOMATIC FIREARMS

CROSS-REFERENCE TO RELATED APPLICATIONS

This application claims priority to, incorporates herein by reference, and is a non-provisional of U.S. provisional patent application No. 62/288,385 to David Foster, filed Jan. 28, 2016 and entitled Timing Apparatus, System, and Method for Dual Mode Trigger for Semiautomatic Firearms (herein "the '385 Application"). This application also claims priority to, incorporates herein by reference, and is a non-provisional of U.S. provisional patent application No. 62/311,807 to David Foster, filed Mar. 22, 2016 and entitled Trigger Having a Moveable Sear and Firearms Incorporating Same (herein "the '807 Application").

FEDERALLY SPONSORED RESEARCH OR DEVELOPMENT

None.

TECHNICAL FIELD

The present invention relates generally to firearms, and more particularly to improvements to trigger systems for semiautomatic firearms.

BACKGROUND

Selectable dual mode triggers for semiautomatic firearms are known, which include triggers capable of actuating and firing rounds on both pull and release of the trigger. Examples of such systems are disclosed in U.S. Pat. No. 8,667,881 B1 to Hawbaker, granted 2014-03-11 (herein "the '881 Patent"), and U.S. Pat. No. 8,820,211 B1 to Hawbaker, granted 2014-09-02 (herein "the '211 Patent") (collectively "the Hawbaker patents"), both of which are incorporated herein by reference. The characteristics of selecting modes of actuation in which only one round is discharged with one function of the trigger was approved by the ATF and granted the patents mentioned above and incorporated herein.

The introduction of a trigger that actuates on both pull and release presents several challenges. For example, during the testing of this new trigger, misfires were sometimes experienced due to light primer strikes, unexpected trigger states during actuation, and magazine changes. It quickly became apparent that improvements were needed to address these and related issues. In working to solve these problems, innovations were discovered that have applicability to not only pull-and-release triggers, but also to semiautomatic firearms generally.

SUMMARY

One of these innovations is a trigger-locking apparatus, system, and method for semiautomatic firearms, some examples of which are described herein. Illustrative examples of such trigger-locking apparatus were described in the '385 Application (as timing lever 7), and in the '807 Application (as timing lever 5), forming part of the pull-and-release triggers described therein. Such trigger-locking mechanisms can elegantly overcome certain problems of the prior art, such as hammer-follow leading to light primer strikes, and unexpected trigger states during actuation and magazine changes, while providing other advantages.

For example, provided in various example embodiments is a novel apparatus, system, and method for improved control of selectable dual mode trigger systems for semiautomatic firearms, which may include a timed locking mechanism incorporated in the trigger system that ensures that the carrier is seated before the hammer is actuated, and that the anti-hammer follow disconnect does not engage out of sequence. Such a mechanism ensures that the necessary steps occur in the proper sequence in the trigger mechanism, so that at any given time the trigger and firearm are ready for the next desired function to occur. The addition of a timing lever, or timed trigger lock mechanism, to the trigger as disclosed herein ensures that the sequence of events in the trigger is maintained in the proper relationship, preventing misfires and jams. Such trigger locking mechanisms have applicability beyond dual-mode trigger systems, however, and may be applied in various forms to semiautomatic firearms generally.

Accordingly, provided in various example embodiments is a trigger-locking apparatus for a semi-automatic firearm having a trigger and an action that cycles by loading, firing, and extracting cartridges when the firearm is repeatedly fired by movements of the trigger. In various example embodiments the trigger-locking apparatus may comprise a structure that when in a first position allows movement of the trigger between firing and non-firing positions, and when in a second position restricts movement of the trigger between firing and non-firing positions. The trigger-locking apparatus may be configured so that, when it is installed in the semi-automatic firearm, the structure is configured to automatically: be in the first position when the action of the firearm is in an in-battery position ready to fire a first cartridge; move to the second position when the firearm is firing the first cartridge and the action is being cycled; then return to the first position as the action of the firearm cycles back to the in-battery position ready to fire a second cartridge.

In various example embodiments the trigger-locking apparatus may be further configured so that, when it is installed in the semi-automatic firearm, the structure is configured to automatically move to the second position when the firearm is firing the second cartridge and the action is being cycled, then return to the first position as the action of the firearm cycles back to the in-battery position ready to fire a third cartridge. This sequence may be repeated for any suitable number of cartridges.

In various example embodiments the structure is biased toward the first position, for instance by a spring or any other suitable means. In various example embodiments the structure may be configured to move between the first and second positions by pivoting about an axis, while in other example embodiments the structure may be configured to move between the first and second positions by translating linearly.

In various example embodiments the action of the semi-automatic firearm may comprise a carrier assembly that is configured to translate longitudinally when the action is cycled, and the structure may be configured to be moved from the first position to the second position by longitudinal movement of the carrier assembly. In various example embodiments the carrier assembly may comprise a carrier, or a bolt, or any other suitable structure that engages and moves the structure from the first position to the second position when the carrier assembly translates longitudinally in a first direction when the action is cycled. Additionally or alternatively, in various example embodiments the structure may be configured to be moved from the second position to the first position by or in cooperation with longitudinal movement of the carrier assembly. In various example embodiments the carrier assembly may comprise a carrier, or a bolt, or any other suitable structure that engages and moves or allows movement of the structure from the second position to the first position when the carrier assembly translates longitudinally in a second direction when the action is cycled.

In various example embodiments the action of the semi-automatic firearm may comprise a slide that is configured to translate longitudinally when the action is cycled, and the structure may be configured to be moved from the first position to the second position by longitudinal movement of the slide in a first direction. Additionally or alternatively, in various example embodiments the structure may be configured to be moved from the second position to the first position by or in cooperation with longitudinal movement of the slide. In various example embodiments the slide or a structure affixed therewith engages and moves or allows movement of the structure from the second position to the first position when the slide translates longitudinally in a second direction when the action is cycled.

In various example embodiments the trigger-locking apparatus may be configured for use with a semi-automatic firearm having a hammer that is releasably engaged by the trigger and by a secondary disconnector member, wherein the structure is further configured to release the secondary disconnector member from engagement with the trigger when the structure is moved from the first position to the second position. In various example embodiments such structure may be further configured to move the secondary disconnector member to an engagement position to engage with the trigger when the structure is moved from the second position to the first position. In various example embodiments the structure may be configured to move the secondary disconnector member from a position where it can engage the trigger to a position where it cannot engage the trigger when the structure is moved from the first position to the second position. In various example embodiments the structure may be configured to allow the secondary disconnector member to move from a position where it cannot engage the trigger to a position where it can engage the trigger when the structure is moved from the second position to the first position.

Also provided in various example embodiments are semi-automatic firearms incorporating any of the apparatus, features, or functions described herein.

Further provided in various example embodiments are methods of using the firearms, apparatus, features, or functions described herein. For example, provided in various example embodiments is a method of operating the semi-automatic firearms described herein, comprising the steps of moving the trigger and firing the first cartridge, causing the action to cycle and the structure to move from the first position into the second position thereby causing the trigger-locking apparatus to lock the trigger, and as the action of the firearm cycles back to the in-battery position ready to fire the second cartridge, causing the structure to move from the second position back to the first position thereby causing the trigger-locking apparatus to unlock the trigger.

In various example embodiments where the semi-automatic firearm further comprise a hammer that is releasably engaged by the trigger and by a secondary disconnector member, and wherein the structure is further configured to release the secondary disconnector member from engagement with the trigger when the structure is moved from the first position to the second position, and to move the secondary disconnector member to an engagement position to engage with the trigger when the structure is moved from the second position to the first position, the method may further comprise the steps of: causing the structure to release the secondary disconnector member from engagement with the trigger by causing the structure to move from the first position to the second position; and causing the structure to move the secondary disconnector member to an engagement position to engage with the trigger by causing, allowing, or cooperating with the structure to move the structure from the second position to the first position.

The foregoing summary is illustrative only and is not meant to be exhaustive or limiting. Other aspects, objects, and advantages of various example embodiments will be apparent to those of skill in the art upon reviewing the accompanying drawings, disclosure, and appended claims. These together with other objects of the invention, along with various features of novelty, which characterize the invention, are pointed out with particularity in the claims annexed hereto and forming a part of this disclosure. For a better understanding of the invention, its operating advantages and the specific objects attained by its uses, reference should be had to the accompanying drawings, claims and descriptive matter in which there is illustrated a preferred embodiment of the invention.

BRIEF DESCRIPTION OF THE DRAWINGS

FIG. 1A shows the first example embodiment with a first example locking structure rotated to an unlocked position by a carrier assembly that is translated longitudinally forward when the action of the firearm is in an in-battery position ready to fire a cartridge.

FIG. 1B depicts the example embodiment of FIG. 1A with the trigger moving between non-firing and firing positions.

FIG. 1C shows the example embodiment of FIG. 1B with the trigger released and the locking structure rotated to a locked position after it has been released from the unlocked position by movement of the carrier assembly longitudinally rearward in the direction of the arrows, as when the action of the firearm is being cycled during the firing of a cartridge.

FIG. 1D shows the example embodiment of FIG. 1C with the carrier assembly returning longitudinally forward in the direction of the arrows and re-contacting the locking structure as the action of the firearm continues to cycle after the firing of a cartridge.

FIG. 1E shows the embodiment of FIG. 1D with the carrier assembly having fully returned longitudinally forward in the direction of the arrows and re-rotating the locking structure to the unlocked position of FIG. 1A when the action of the firearm is in an in-battery position ready to fire a second cartridge.

FIG. 2A shows the second example embodiment with a second example locking structure translated to an unlocked position by a carrier assembly that is translated longitudinally forward when the action of the firearm is in an in-battery position ready to fire a cartridge.

FIG. 2B depicts the example embodiment of FIG. 2A with the trigger moving between non-firing and firing positions.

FIG. 2C shows the example embodiment of FIG. 2B with the trigger released and the locking structure translated to a locked position after it has been released from the unlocked position by movement of the carrier assembly longitudinally rearward in the direction of the arrows, as when the action of the firearm is being cycled during the firing of a cartridge.

FIG. 2D shows the example embodiment of FIG. 2C with the carrier assembly returning longitudinally forward in the direction of the arrows and re-contacting the locking structure as the action of the firearm continues to cycle after the firing of a cartridge.

FIG. 2E shows the embodiment of FIG. 2D with the carrier assembly having fully returned longitudinally forward in the direction of the arrows and re-translating the locking structure to the unlocked position of FIG. 2A when the action of the firearm is in an in-battery position ready to fire a second cartridge.

FIG. 3A shows the third example embodiment with the third example locking structure rotated to an unlocked position by a carrier assembly that is translated longitudinally forward when the action of the firearm is in an in-battery position ready to fire a cartridge. In this unlocked position, the third example locking structure has allowed the secondary disconnector member to move to an engagement position to engage with the trigger.

FIG. 3B is a closer view of a portion of FIG. 3A.

FIG. 4 shows the third example embodiment with the third example locking structure rotated to locked position as when the carrier assembly of FIG. 3A (not shown in FIG. 4) is translated longitudinally rearward as when the action of the firearm is being cycled during the firing of a cartridge. In this locked position, the third example locking structure has moved the secondary disconnector member to a position where it will not engage with the trigger.

DETAILED DESCRIPTION OF EXAMPLE EMBODIMENTS

Figure 1A:
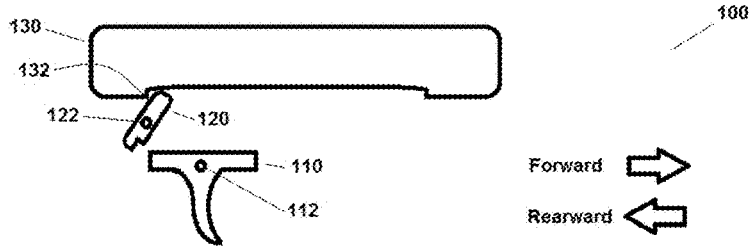
FIGS. 1A-1E illustrate a first example embodiment of a trigger-locking apparatus, system, and method for semiautomatic firearms that have an action that cycles by loading, firing, and extracting cartridges when the firearm is repeatedly fired by movements of the trigger, comprising a first example structure that when in an unlocked position shown in FIGS. 1A, 1B, 1E, allows movement of the trigger between non-firing and firing positions as shown in FIGS. 1A and 1B, and when in a locked position shown in FIGS. 1C and 1D, restricts movement of the trigger between firing and non-firing positions.

Reference will now be made in detail to some specific example embodiments, including any best mode contemplated by the inventor. Examples of these specific embodiments are illustrated in the accompanying drawings. While the invention is described in conjunction with these specific embodiments, it will be understood that it is not intended to limit the invention to the described or illustrated embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments may be implemented without some or all of these features or specific details. In other instances, components and procedures well known to persons of skill in the art have not been described in detail in order not to obscure inventive aspects.

Various techniques and mechanisms will sometimes be described in singular form for clarity. However, it should be noted that some embodiments may include multiple iterations of a technique or multiple components, mechanisms, and the like, unless noted otherwise. Similarly, various steps of the methods shown and described herein are not necessarily performed in the order indicated, or performed at all in certain embodiments. Accordingly, some implementations of the methods discussed herein may include more or fewer steps than those shown or described.

Further, the example techniques and mechanisms described herein will sometimes describe a connection, relationship or communication between two or more items or entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

To ensure clarity, an explanation of the term "in-battery" will now be provided. "In-battery" refers to the status of a firearm once the action has returned to the normal firing position. Out-of-battery refers to the status of a firearm before the action has returned to the normal firing position. According to the website Wikipedia, the term originates from artillery, referring to a gun that fires before it has been pulled back. In artillery guns, "out of battery" usually refers to a situation where the recoiling mass (breech and barrel) has not returned to its proper position after firing because of a failure in the recoil mechanism. Gun carriages should normally be designed to prevent this in typical circumstances. But if a gun is fired out of battery, then damage to the carriage can occur, as the effectiveness of the recoil mechanism will have been compromised. In firearms and artillery where there is an automatic loading mechanism, a condition can occur in which a live round is at least partially in the firing chamber and capable of being fired, but is not properly secured by the usual mechanism of that particular weapon (and thus is not "in battery"). The gas pressure produced at the moment of firing can rupture the not-fully-supported cartridge case and can result in flame and high-pressure gas being vented at the breech of the weapon, potentially creating flying shrapnel and possibly injuring the operator. Depending on the design, it is also possible for a semi-automatic firearm to simply not fire upon pulling the trigger when in an out-of-battery state. The present locking mechanisms 100, 200, 300 and the like are designed to prevent pulling the trigger 110 when the firearm is in an out-of-battery state, which can sometimes happen in most if not all semi-automatic firearms, but is a special risk in those firearms capable of firing upon both the pull and the release of the trigger 110.

Referring now to the drawings in detail to the drawings wherein like elements are indicated by like numerals, there are shown various aspects of example trigger-locking apparatus, system, and method for semiautomatic firearms. FIGS. 1A-1E illustrate a first example embodiment of certain portions of a trigger-locking apparatus, system, and method 100 for semiautomatic firearms. While not reproduced in the present figures for the sake of visual clarity, it is well known that semiautomatic firearms typically have a mechanism commonly known as an action that cycles by loading, firing, and extracting cartridges when the firearm is repeatedly fired by movements of the trigger. Here, the system 100 may comprise a trigger 110, which may pivot about an axis 112 between firing and non-firing positions (indicated by arrow 114), or may alternatively move laterally or may be actuated in any other suitable manner (not shown).

Figure 1B:
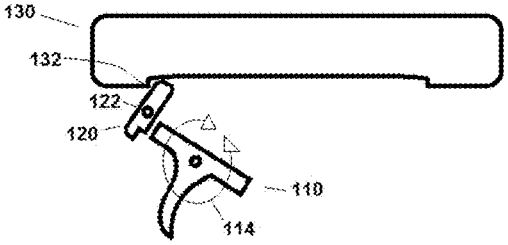
Figure 1C:
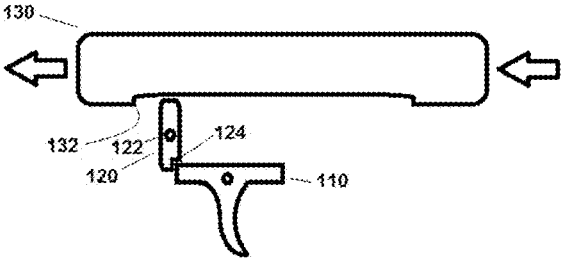
Figure 1D:
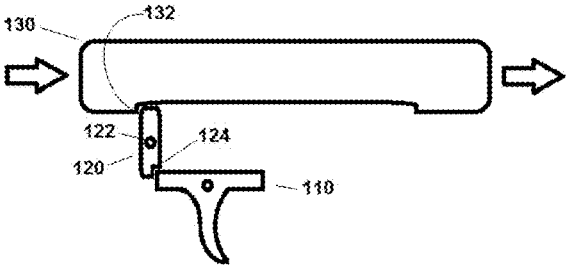
Figure 1E:
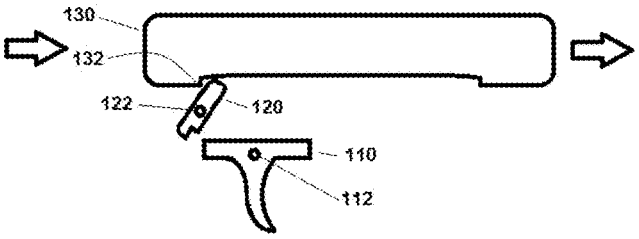

The system 100 may comprise a structure 120 that when in an unlocked position shown in FIGS. 1A, 1B, 1E, allows movement 114 of the trigger 110 between non-firing and firing positions as shown in FIGS. 1A and 1B. Turning to FIG. 1A, shown is a first example embodiment 100 with a first example locking structure 120 rotated about an axis 122 to an unlocked position by a carrier assembly 130 that is translated longitudinally forward (as indicated by the Forward arrow on the figures) when the action of the firearm is in an in-battery position ready to fire a cartridge (not shown). More specifically, in the example embodiment 100, an engagement feature 132 may be provided on or as part of carrier assembly 130 that when longitudinally translated forward and adjacent the structure 120, mechanically engages an upper portion of the structure 120 (that portion above the axis 122) and pushes it forward, thus causing the structure 120 to pivotally rotate about axis 122 in a clockwise direction as shown in FIGS. 1A and 1B, until the trigger 110 can rotate about its axis 112 sufficiently to fire a cartridge without the structure 120 interfering with the movement 114 of the trigger 110. This is the unlocked position.

The carrier assembly 130 may comprise any suitable components and features, such as a carrier, bolt assembly, bolt, and the like, as is known in the art of semi-automatic rifles, for instance. Alternatively, carrier assembly 130 may comprise a slide, for instance as is known in the art of semi-automatic pistols. Engagement feature 132 may comprise or be formed onto, into, or as part of any portion of the carrier assembly 130, and may comprise an abutment, a groove, or a convex or concave surface, or any other mechanical structure that will suitably function to mechanically engage the locking structure 120.

A spring or other biasing means (not shown) may be provided to rotationally urge the structure 120 in a counter-clockwise direction about the axis 122. For example and not by way of limitation, a torsional spring may be affixed against the structure 120 and around axis 122, or a helical compression spring may be provided pushing the upper portion of the structure 120 (that portion above the axis 122) in the rearward direction, or a helical compression spring may be provided pushing the lower portion of the structure 120 (that portion below the axis 122) in the forward direction, for example.

Once the trigger 110 is actuated by movement 114 between firing and non-firing positions and a cartridge is fired, the action of the firearm begins to cycle causing the carrier assembly 130 to move rearward as depicted in FIG. 1C. This moves the engagement feature 132 away from the locking structure 120, allowing the spring or other urging means discussed above but not shown to cause the locking structure 120 to automatically rotate counter-clockwise around axis 122, such that when the trigger 110 is moved 114 between firing and non-firing positions, for instance when it is released, the locking structure 120 automatically engages the trigger 110 at a locking interface 124 and locks the trigger 110 in position as shown in FIGS. 1C and 1D, thereby restricting movement 114 of the trigger 110 between firing and non-firing positions while the action of the firearm is out-of-battery.

FIG. 1D shows the example embodiment 100 discussed above with respect to FIG. 1C with the carrier assembly 130 returning longitudinally forward in the direction of the arrows and the engagement feature 132 of the carrier assembly 130 re-contacting the locking structure 120 as the action of the firearm continues to cycle after the firing of a cartridge.

FIG. 1E shows the example embodiment 100 discussed above with respect to FIG. 1D with the carrier assembly 130 having fully returned longitudinally forward in the direction of the arrows when the action of the firearm is in an in-battery position ready to fire a second cartridge. The engagement feature 132 of the carrier assembly 130 has pushed forward the upper portion of the locking structure 120, causing the locking structure 120 to rotate clockwise against whatever spring forces may be urging the locking structure in the counter-clockwise direction, and the firearm and its components are in the same positions and states as they were at the beginning of the process as shown and described with respect to FIG. 1A, namely with the trigger 110 automatically unlocked and free to move 114 as shown in FIG. 1B once the action of the firearm returns to in-battery position. This sequence can be repeated any number of times with any number of cartridges.

FIGS. 2A-2E illustrate a second example embodiment of a trigger-locking apparatus, system, and method 200 for semiautomatic firearms that have an action that cycles by loading, firing, and extracting cartridges when the firearm is repeatedly fired by movements of the trigger. System 200 may comprise a trigger 210, which may pivot about an axis 112 between firing and non-firing positions (indicated by arrow 114), or may alternatively move laterally or may be actuated in any other suitable manner (not shown).

Figure 2A:
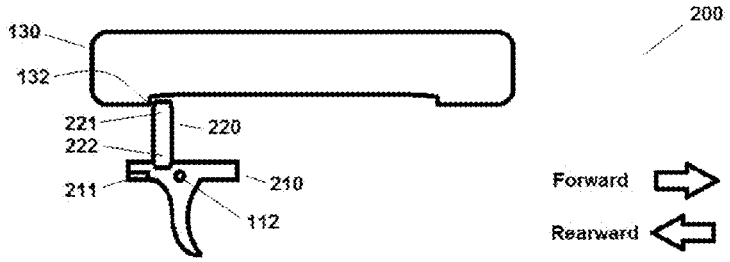
FIGS. 2A-2E illustrate a second example embodiment of a trigger-locking apparatus, system, and method for semi-automatic firearms that have an action that cycles by loading, firing, and extracting cartridges when the firearm is repeatedly fired by movements of the trigger, comprising a second example structure that when in an unlocked position shown in FIGS. 2A, 2B, 2E, allows movement of the trigger between non-firing and firing positions as shown in FIGS. 2A and 2B, and when in a locked position shown in FIGS. 2C and 2D, restricts movement of the trigger between firing and non-firing positions.
Figure 2B:
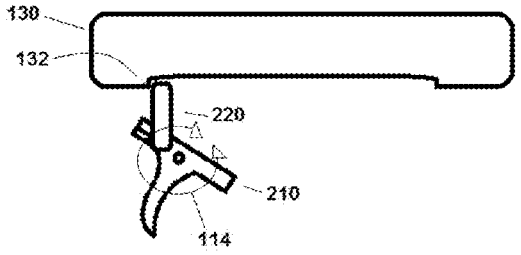
Figure 2C:
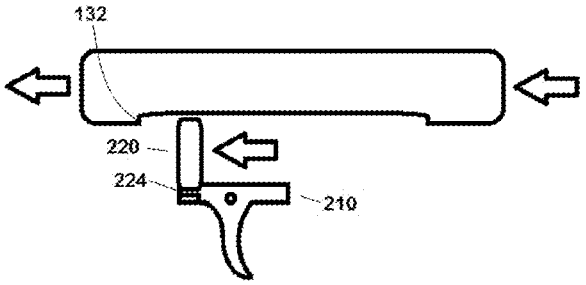
Figure 2D:
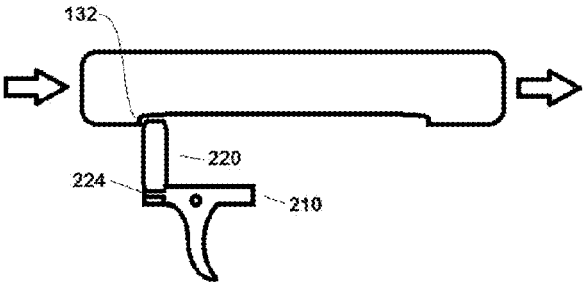
Figure 2E:
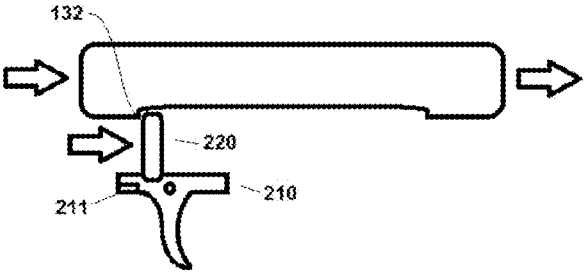

The system 200 may comprise a structure 220 that when in an unlocked position shown in FIGS. 2A, 2B, 2E, allows movement 114 of the trigger 210 between non-firing and firing positions as shown in FIGS. 2A and 2B. Turning to FIG. 2A, shown is a second example embodiment 200 with a second example locking structure 220 that translates linearly in a forward direction (as indicated by the Forward arrow on the figures), to an unlocked position by a carrier assembly 130 that is also translated longitudinally forward when the action of the firearm is in an in-battery position ready to fire a cartridge (not shown). More specifically, in the example embodiment 200, an engagement feature 132 may be provided on or as part of carrier assembly 130 that when longitudinally translated forward and adjacent the structure 220, mechanically engages an upper portion 221 of the structure 220 and pushes the whole structure 220 to a forward position as shown in FIGS. 2A and 2B (for instance in a channel or other guiding structure, not shown), until the trigger 210 can rotate about its axis 112 sufficiently to fire a cartridge without the structure 220 interfering with the movement 114 of the trigger 210. This is the unlocked position.

The carrier assembly 130 may comprise any suitable components and features as described herein with respect to the first embodiment 100, and will suitably function to mechanically engage the locking structure 220 as described herein.

A spring or other biasing means (not shown) may be provided to urge the structure 220 in a rearward direction (as indicated by the Rearward arrow on the figures). For example and not by way of limitation, a helical compression spring may be provided pushing the structure 220 in the rearward direction, for example.

Once the trigger 210 is actuated by movement 114 between firing and non-firing positions and a cartridge is fired, the action of the firearm begins to cycle causing the carrier assembly 130 to move rearward as depicted in FIG. 2C. This moves the engagement feature 132 away from the locking structure 220, allowing the spring or other urging means discussed above but not shown to cause the locking structure 220 to automatically translate linearly in the rearward direction, such that when the trigger 210 is moved 114 between firing and non-firing positions, for instance when it is released, a lower portion 222 of the locking structure 220 automatically engages an engagement feature 211 of the trigger 210 at a locking interface 224 and locks the trigger 210 in position as shown in FIGS. 2C and 2D, thereby restricting movement 114 of the trigger 210 between firing and non-firing positions while the action of the firearm is out-of-battery.

FIG. 2D shows the example embodiment 200 discussed above with respect to FIG. 2C with the carrier assembly 130 returning longitudinally forward in the direction of the arrows and the engagement feature 132 of the carrier assembly 130 re-contacting the locking structure 220 as the action of the firearm continues to cycle after the firing of a cartridge.

FIG. 2E shows the example embodiment 200 discussed above with respect to FIG. 2D with the carrier assembly 130 having fully returned longitudinally forward in the direction of the arrows when the action of the firearm is in an in-battery position ready to fire a second cartridge. The engagement feature 132 of the carrier assembly 130 has pushed forward the locking structure 220, causing the locking structure 220 to move linearly forwards against whatever spring forces may be urging the locking structure 220 in the rearward direction, and the firearm and its components are in the same positions and states as they were at the beginning of the process as shown and described with respect to FIG. 2A, namely with the trigger 210 automatically unlocked and free to move 114 as shown in FIG. 2B once the action of the firearm returns to in-battery position. This sequence can be repeated any number of times with any number of cartridges.

Figures 3A, 3B:
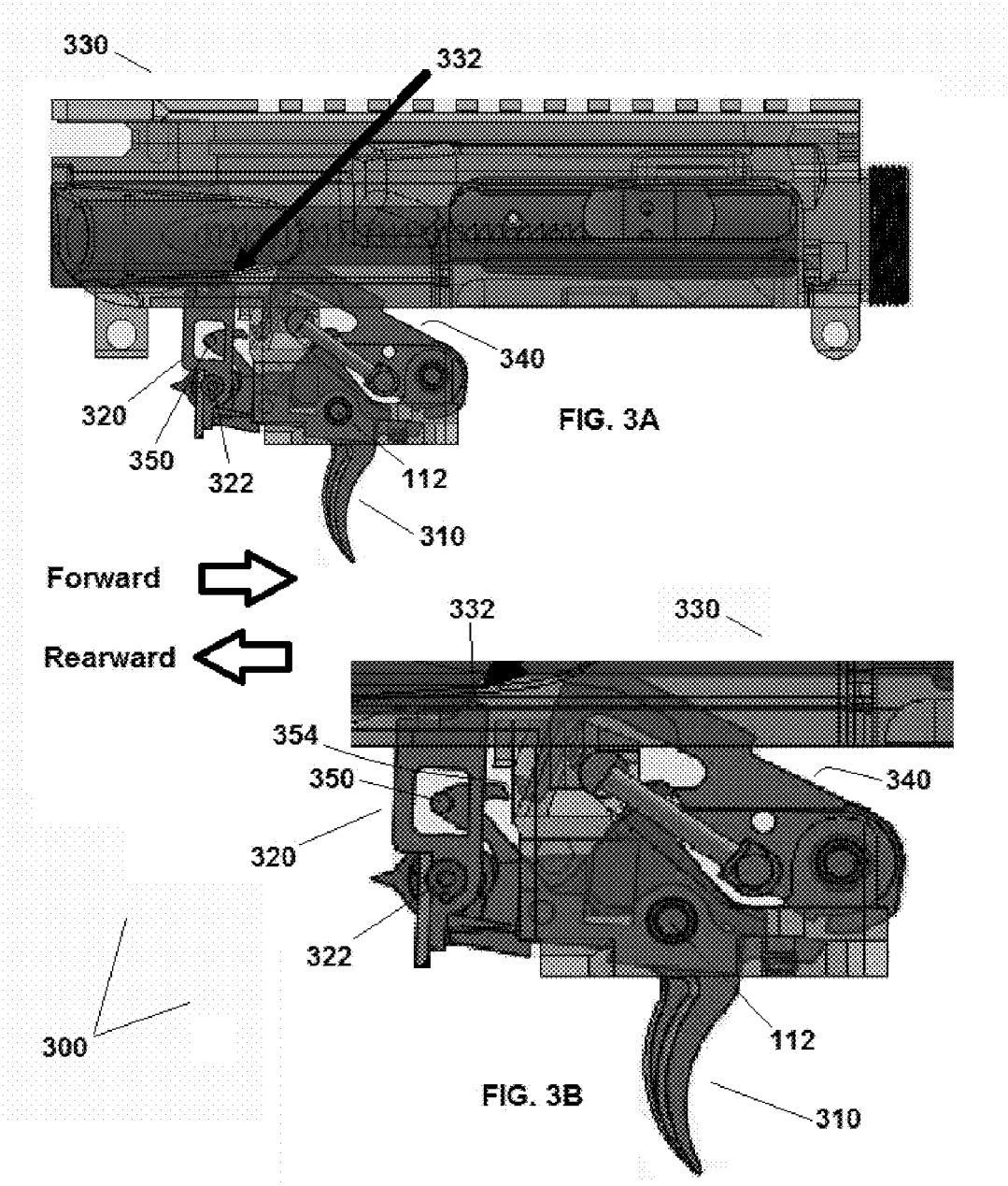
FIGS. 3A, 3B, and 4 illustrate a third example embodiment of a trigger-locking apparatus, system, and method for semiautomatic firearms that have an action that cycles by loading, firing, and extracting cartridges when the firearm is repeatedly fired by movements of the trigger, comprising a third example structure that when in an unlocked position shown in FIGS. 3A, 3B, allows movement of the trigger between non-firing and firing positions, and when in a locked position shown in FIG. 4, restricts movement of the trigger between firing and non-firing positions. The third example embodiment includes a hammer that is releasably engaged by the trigger and by a secondary disconnector member.
Figure 4:
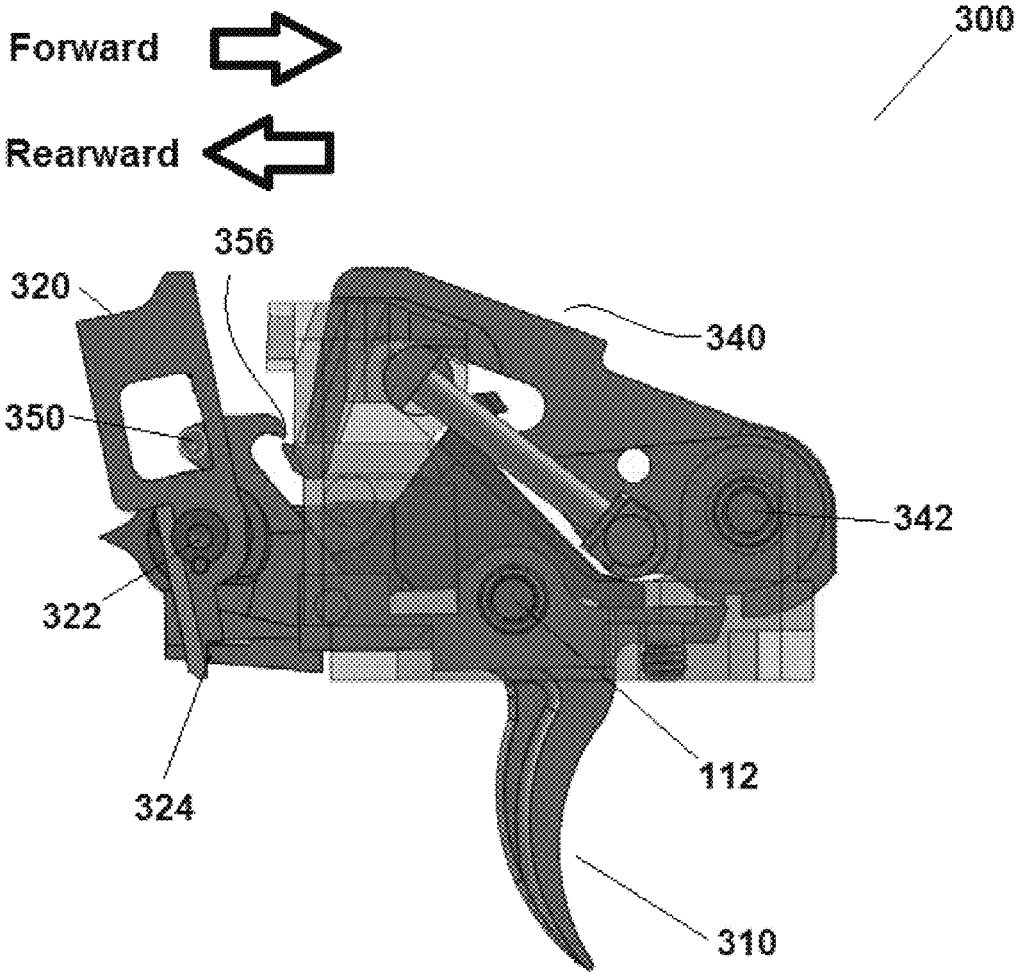

FIGS. 3A, 3B, and 4 illustrate a third example embodiment 300 of a trigger-locking apparatus, system, and method for semiautomatic firearms that have an action that cycles by loading, firing, and extracting cartridges when the firearm is repeatedly fired by movements of the trigger 310. This example embodiment 300 illustrates certain components of a trigger assembly that is capable of firing on both pull-and-release, and comprises a third example locking structure 320 that when in an unlocked position shown in FIGS. 3A, 3B, allows movement of the trigger 310 between non-firing and firing positions, and when in a locked position shown in FIG. 4, restricts movement of the trigger 310 between firing and non-firing positions. The third example embodiment 300 includes a hammer 340 that is releasably engaged by the trigger 310 and by a secondary disconnector member 350.

FIGS. 3A and 3B show the third example embodiment 300 with the third example locking structure 320 rotated about an axis 322 to an unlocked position by a carrier assembly 330 that is translated longitudinally forward (as shown by the arrow labeled Forward in the figures) when the action of the firearm is in an in-battery position ready to fire a cartridge. More specifically, an engagement feature 332 on the carrier assembly 330 is in a forward position having pushed forward a top portion of the locking structure 320, causing the locking structure 320 to rotate clockwise about its pivotal axis 322. In this unlocked position, the third example locking structure 320 clears the trigger 310, so that the trigger 310 may be actuated and rotated about its pivotal axis 112. Also in this unlocked position, the third example locking structure 320 is not engaging the secondary disconnector member 350 and has allowed the secondary disconnector member 350 to move to an engagement position 354 where it can engage with a corresponding hook on the hammer 340 when the hammer 340 is rotated further counterclockwise (for instance as shown in FIG. 4).

FIG. 4 shows the third example embodiment 300 with the third example locking structure 320 rotated counterclockwise about its axis 322 to a locked position, as when the carrier assembly 330 of FIG. 3A (not shown in FIG. 4) is translated longitudinally rearward, for instance when the action of the firearm is being cycled during the firing of a cartridge. More specifically, in FIG. 4 an engagement feature 332 on the carrier assembly 330 would now be in a rearward position, like carrier assembly 130 in FIG. 1C, and would no longer be pushing forward on a top portion of the locking structure 320, thereby allowing the locking structure 320 to automatically rotate counter-clockwise about its pivotal axis 322 (under the rotational force of an urging mechanism like a spring as discussed with regarding to embodiment 100). In this locked position, the third example locking structure 320 forms a locking interface 324 with the trigger assembly 310, so that the trigger 310 may not be actuated and rotated about its pivotal axis 112, thereby locking the trigger 310 when the action of the firearm is out-of-battery. Also in this locked position, the third example locking structure 320 engages the secondary disconnector member 350 and pulls it rearward to a disengagement position 356 where it will not engage with the corresponding hook on the hammer 340. This ensures that the secondary disconnector member 350, also sometimes referred to as an anti-hammer-follow disconnect, does not engage out of sequence.

As the action of the firearm returns to battery and the carrier assembly 330 moves back to its forward position, the above embodiment 300 will return to the state shown in FIG. 3A, with the trigger 310 unlocked and the secondary disconnector 350 back in position 354 to engage the hammer 340. This sequence can be repeated any number of times with any number of cartridges.

It is understood that the above-described embodiments are merely illustrative of the application. Other embodiments may be readily devised by those skilled in the art, which may embody one or more aspects or principles of the invention and fall within the scope of the claims. For example, it is contemplated that the present principles could be employed with many other locking mechanisms other than those disclosed as locking structures 120, 220, 320, such as plunger designs, rotating cams, gears, or ratchets, or any other suitable structure that achieves the present purposes. Any suitable materials and manufacturing methods may be used as would be apparent to persons of skill in the art.

What is claimed is:

1. A trigger-locking apparatus for a semi-automatic firearm having a trigger and an action that cycles by a carrier assembly element translating longitudinally and the action loading, firing, and extracting cartridges when the firearm is repeatedly fired by movements of the trigger, the trigger-locking apparatus comprising:

a structure that when in a first position allows movement of the trigger between firing and non-firing positions, and when in a second position restricts movement of the trigger between firing and non-firing positions;

the trigger-locking apparatus configured so that, when it is installed in the semi-automatic firearm, the structure is configured to:

be held in the first position by contact with the carrier assembly element when the action of the firearm is in an in-battery position ready to fire a first cartridge;

be released from contact with the carrier assembly element and, only upon release of the trigger, move to the second position when the firearm is firing the first cartridge and the action is being cycled; then be returned to the first position by contact with the carrier assembly element as the action of the firearm cycles back to the in-battery position ready to fire a second cartridge.

2. The trigger-locking apparatus of claim 1, wherein the trigger-locking apparatus is further configured so that, when it is installed in the semi-automatic firearm, the structure is configured to:

be released from contact with the carrier assembly element and, only upon release of the trigger, move to the second position when the firearm is firing the second cartridge and the action is being cycled; then be returned to the first position by contact with the carrier assembly element as the action of the firearm cycles back to the in-battery position ready to fire a third cartridge.

3. The trigger-locking apparatus of claim 1, wherein the structure is biased toward the second position by a spring.

4. The trigger-locking apparatus of claim 1, wherein the structure is configured to move between the first and second positions by pivoting about an axis.

5. The trigger-locking apparatus of claim 1, wherein the structure is configured to move between the first and second positions by translating linearly.

6. The trigger-locking apparatus of claim 1, wherein the carrier assembly element comprises any of a carrier or a bolt that engages and moves the structure from the first position to the second position when the carrier assembly element translates longitudinally when the action is cycled.

7. The trigger-locking apparatus of claim 1, wherein the action of the semi automatic firearm carrier assembly element comprises a slide that is configured to translate longitudinally when the action is cycled, and the structure is configured to be moved from the first position to the second position by longitudinal movement of the slide.

8. The trigger-locking apparatus of claim 1, for a semi-automatic firearm having a hammer that is releasably engaged by the trigger and by a secondary disconnector member, wherein the structure is further configured to move the secondary disconnector member from a position where it can engage the trigger to a position where it cannot engage the trigger when the structure is moved from the first position to the second position.

9. The trigger-locking apparatus of claim 8, wherein the structure is further configured to allow the secondary disconnector member to move from a position where it cannot engage the trigger to a position where it can engage the trigger when the structure is moved from the second position to the first position.

10. A semi-automatic firearm having a trigger, a trigger-locking apparatus, and an action that cycles by a carrier assembly element translating longitudinally and the action loading, firing, and extracting cartridges when the firearm is repeatedly fired by movements of the trigger, the trigger-locking apparatus comprising:

a structure that when in a first position allows movement of the trigger between firing and non-firing positions, and when in a second position restricts movement of the trigger between firing and non-firing positions;

the trigger-locking apparatus configured so that, when it is installed in the semi-automatic firearm, the structure is configured to:

be held in the first position by contact with the carrier assembly element when the action of the firearm is in an in-battery position ready to fire a first cartridge;

be released from contact with the carrier assembly element and, only upon release of the trigger, move to the second position when the firearm is firing the first cartridge and the action is being cycled; then be returned to the first position by contact with the carrier assembly element as the action of the firearm cycles back to the in-battery position ready to fire a second cartridge.

11. The semi-automatic firearm of claim 10, wherein the structure is further configured to:

be released from contact with the carrier assembly element and, only upon release of the trigger, move to the second position when the firearm is firing the second cartridge and the action is being cycled; then be returned to the first position by contact with the carrier assembly element as the action of the firearm cycles back to the in-battery position ready to fire a third cartridge.

12. The semi-automatic firearm of claim 10, wherein the structure is biased toward the second position by a spring.

13. The semi-automatic firearm of claim 10, wherein the structure is configured to move between the first and second positions by pivoting about an axis.

14. The semi-automatic firearm of claim 10, wherein the carrier assembly element comprises a slide that is configured to translate longitudinally when the action is cycled, and the structure is configured to be moved from the first position to the second position by longitudinal movement of the slide.

15. The semi-automatic firearm of claim 10, further comprising a hammer that is releasably engaged by the trigger and by a secondary disconnector member, wherein the structure is further configured to move the secondary disconnector member from a position where it can engage the trigger to a position where it cannot engage the trigger when the structure is moved from the first position to the second position.

16. The semi-automatic firearm of claim 15, wherein the structure is further configured to allow the secondary disconnector member to move from a position where it cannot engage the trigger to a position where it can engage the trigger when the structure is moved from the second position to the first position.

17. A method of operating a semi-automatic firearm, comprising the steps of:

providing the semi-automatic firearm of claim 10;

moving the trigger and firing the first cartridge and then releasing the trigger, thereby causing the action to cycle and the structure to move from the first position into the second position thereby causing the trigger-locking apparatus to lock the trigger, and as the action of the firearm cycles back to the in-battery position ready to fire the second cartridge, causing the structure to move from the second position back to the first position thereby causing the trigger-locking apparatus to unlock the trigger.

18. The method of claim 17, wherein the semi-automatic firearm further comprises a hammer that is releasably engaged by the trigger and by a secondary disconnector member, and wherein the structure is further configured to release the secondary disconnector member from engagement with the trigger when the structure is moved from the first position to the second position, and to move the secondary disconnector member to an engagement position to engage with the trigger when the structure is moved from the second position to the first position, the method further comprising the steps of:

causing the structure to release the secondary disconnector member from engagement with the trigger by causing the structure to move from the first position to the second position; and causing the structure to move the secondary disconnector member to an engagement position to engage with the trigger by causing the structure to move from the second position to the first position.

* * * * *